United States Patent [19]

Simonsen

[11] 4,427,965

[45] Jan. 24, 1984

[54] RESISTOR COOLANT DEVICE

[76] Inventor: Bent P. Simonsen, 27 Starfish Ct., Newport Beach, Calif. 92663

[21] Appl. No.: 284,530

[22] Filed: Jul. 20, 1981

[51] Int. Cl.[3] ..... H01C 1/082

[52] U.S. Cl. ..... 338/55; 361/385

[58] Field of Search ..... 338/53, 55, 231; 324/158 R, 158 MG, 106; 361/385

[56] References Cited

U.S. PATENT DOCUMENTS 1,196,254 8/1916 McCormick ..... 338/231

1,267,973 5/1918 Chubb ..... 338/55

2,331,773 10/1943 Graham ..... 338/55

3,882,297 5/1975 Avalon ..... 338/55

*Primary Examiner*—C. L. Albritton

[57] ABSTRACT

An electric resistor coolant device is provided which comprises a lined tank for inclusion of water or other coolant containing a water inlet and outlet in which is submerged one or more electric resistor coils. The electric resistor coils are utilized in the load testing of certain electric power supply sources. Heat generated in the resistors by the electrical charge is carried away by the water contained in the tank, thereby increasing the capacity of the coils to carry electric current.

2 Claims, 1 Drawing Figure

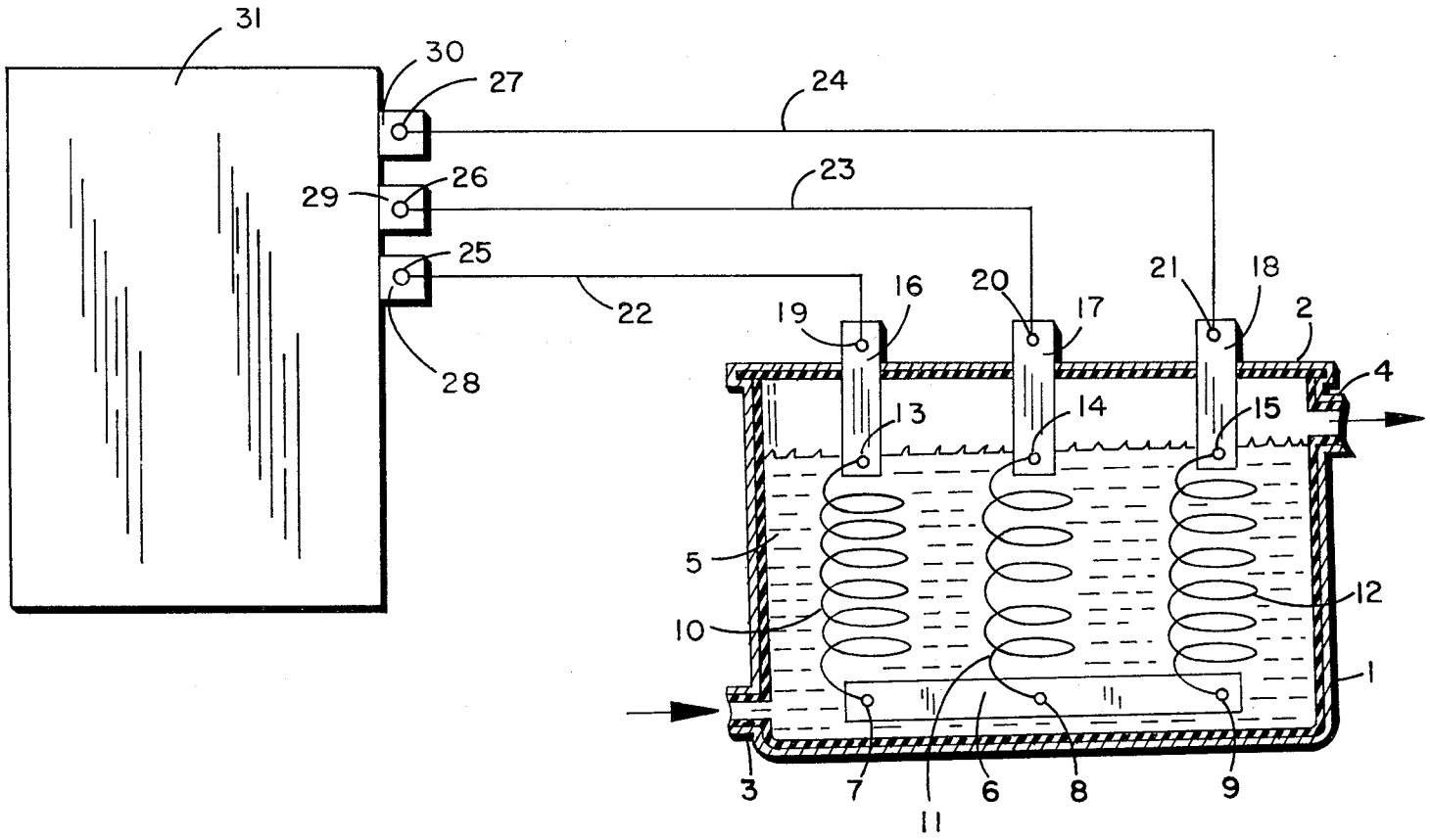
1
2
3
4
5
6
7
8
9
10
11
12
13
14
15
16
17
18
19
20
21
22
23
24
25
26
27
28
29
30
31

RESISTOR COOLANT DEVICE

INTRODUCTION

The providing of resistant wire coils for the load testing of certain electrical supply sources is now common. An electric power source, such as an engine generator, is generally tested for maximum current or power output utilizing one or more wire coil resistors. One problem in the art, however, is that the heat generated by the charge of current flowing through the resistors limits the current carrying capacity of the resistors, thus the resistors limit the amount of current that can be supplied by the electrical power source to be tested, and not by the electrical power source itself. Since it is desired to test the maximum current generating capacity of the electrical source, it is desirable that the coil resistors which form part of the test device have a high current carrying capacity, i.e. low resistance, and not limit the current carrying capacity of the system.

I have discovered a method whereunder heat from the test coil resistors can be easily removed to overcome the above problem.

Accordingly, one object of the invention is to provide a coolant device for test resistor wire coils. Another object of the invention is to increase the current carrying capacity of test wire coils. A third object of the invention is a device wherein water or any other electrically conductive fluid may be utilized to cool the resistor coils. Other objects of the invention can be seen from the following description.

DESCRIPTION OF THE INVENTION

The device of this invention comprises a test tank which includes an inlet and outlet for the coolant fluid; means to attach or include one or more wire coil resistors submerged within said fluid in said tank; and means to connect said coils to the power supply to be tested. Generally, a plurality of coils are submerged within the coolant, such coils being connected to the power supply, and the opposite ends of the coils attached to a "bus". Heat from the resistors is removed by the coolant fluid, such coolant fluid preferably being water. It is required that the tank be lined with a electrical insulator material, such as teflon, nylon, epoxyl, or other such material, if water or any other electrically conductive material is utilized as the coolant. If a coolant is utilized which is not electrically conductive, the tank need not be lined, or can contain a mimimal amount of lining material. I have devised a portable and relatively lightweight tank such that a person can easily transport the tank system. Also, several tank units may be utilized if desired.

DESCRIPTION OF THE DRAWING

The FIGURE shows a schematic of the device. Tank 1 is shown with a tank top 2. The tank may be closed with such a top 2 or open to the atmosphere. The tank includes a water inlet 3 and outlet 4. Water or other liquid 5 is contained within the tank at a level above the level of the coils such that the coils are fully submerged within the water or other liquid. A "bus" 6 is shown with suitable connectors 7, 8, and 9, such that the wire coils 10, 11 and 12 are in intimate contact with bus 6, and thus in electrical contact with each other at the terminal end of the coils. Each coil is shown contacting another series of "busses" by connectors 13, 14, and 15, such that each is connected with busses 16, 17, and 18, which are in electrical contact with power supply source or generator 13, with electrical wire means 22, 23 and 24 utilizing connectors 19, 20 and 21, together with electrical connector means 25, 26, 27, connectors with appropriate busses 28, 29 and 30.

It can be readily seen that current from the power source 31 is sent through the coils and a test load is created by the resistance of the coil. The water removes the heat generated by the power through the coils such that the coils do not overheat and form an unusually high resistance because of their temperature. In the event that there is a lack of water supply, and the coils become bare, the coils act as a "fuse" in that they will overheat and thus limit the amount of current through the coils.

Liquids other than water may be utilized as the coolant. If an electrically conductive liquid is utilized, such as water, the tank is preferably lined with teflon, nylon, epoxyl, or other insulating material, preferably on both the inside and outside to insure safety to the operator. If the liquid is not electrically conductive, such lining may be omitted. Generally, it is preferable that the lining be utilized to insure safety. The amount of lining is dependent on the amount of the charge and type of coolant fluid. It is preferable that water be utilized in that water is relatively inexpensive and can be discarded after being heated. Other, more expensive, fluids would have to undergo heat exchange cooling and return to make the system economically feasible. For this reason, it is generally preferable that the tank be lined, preferably on both the inside and outside.

I claim:

1. A current test tank device for use in testing electric power sources comprising:

(a) A tank capable of containing water as a coolant liquid;

(b) A coolant liquid inlet and outlet to said tank;

(c) A plurality of coil resistors contained within said tank and submerged within said liquid within said tank;

(d) Means of connecting one end of each of said coils to a power source to be tested;

(e) A lining contained in the interior of the tank comprising an electrical insulator.

2. The device of claim 1 wherein said liquid coolant is water, and wherein said tank is lined with an electrical insulator.

* * * * *